US005753853A

United States Patent [19]

Monte et al.

[11] Patent Number: 5,753,853

[45] Date of Patent: *May 19, 1998

[54] SOLID PROPELLANT WITH TITANATE BONDING AGENT

[75] Inventors: Salvatore J. Monte, Staten Island, N.Y.; Gerald Sugerman, Allendale, N.J.; Scott J. Dixon, Colorado Springs, Colo.

[73] Assignee: Kenrich Petrochemicals, Inc., Bayonne, N.J.

[ * ] Notice: The term of this patent shall not extend beyond the expiration date of Pat. No. 5,753,853.

[21] Appl. No.: 835,879

[22] Filed: Feb. 20, 1986

[51] Int. Cl.[6] ..... C06B 45/10

[52] U.S. Cl. ..... 149/19.2; 149/19.4; 149/19.9

[58] Field of Search ..... 149/19.2, 19.1, 149/19.9

[56] References Cited

U.S. PATENT DOCUMENTS

| | | | |
|---|---|---|---|
| 3,891,482 | 6/1975 | Brown et al. | 149/19.9 |
| 4,050,968 | 9/1977 | Goldhagen et al. | 149/19.4 |
| 4,090,893 | 5/1978 | Cuckser et al. | 149/19.9 |
| 4,122,062 | 10/1978 | Monte et al. | 524/567 |
| 4,430,131 | 2/1984 | Tremblay | 149/19.4 |
| 4,597,924 | 7/1986 | Allen et al. | 149/19.4 |
| 4,634,785 | 1/1987 | Sugerman | 556/17 |

*Primary Examiner*—Edward A. Miller

*Attorney, Agent, or Firm*—Darby & Darby

[57] ABSTRACT

Liquid elastomer-based propellant having incorporated therein organo-titanate compounds are described. The organo-titanates have positive ballistic and physical effects on the propellants, serving to reduce burn rate exponents and overall burn rates, as well as increasing the tensile strength and elasticity of the propellant. Organo-phosphate and pyro-phosphate titanates are used as the preferred organo-titanates.

12 Claims, 1 Drawing Sheet

SOLID PROPELLANT WITH TITANATE BONDING AGENT

BACKGROUND OF THE INVENTION

Solid propellants, which are conventionally composed of finely divided oxidizer materials dispersed in a resinous binder, are useful for jet propulsion devices such as missiles, rockets, and gas generators. Desirably, such materials are cast into a metallic combustion chamber which is incorporated into the jet propulsion device. See, for example, U.S. Pat. No. 3,050,423, which is incorporated by reference herein.

Because of the extreme stress which the propellant is subjected to during the burn and the need to accurately control the rate of burn, the formation of a fully satisfactory system has been elusive. In order to prevent the physical deterioration of the propellant, it is necessary that the mass have high elasticity and tensile strength, since cracking and other imperfections may lead to uncontrolled or erratic burning. Furthermore, the tendency of the propellant to burn at an accelerating rate must be suppressed for dependable operations. These problems are described in detail in the aforesaid U.S. patent.

To prepare a solid propellant having acceptable physical properties, it is necessary to carefully control the geometry of the particulates and to employ adhesion promoters such as aziridine to form a properly bonded charge. Additionally only certain types of resinous materials have been found useful in light of the need to control the burning rates of the solid propellant, which is particularly difficult under the varied pressure conditions experienced in the combustion chamber during the burn.

BRIEF DESCRIPTION OF THE INVENTION

In accordance with the instant invention, it has been discovered that the incorporation of certain select organo-titanates and zirconates into the propellant markedly improves the physical properties and, particularly in the case of organo-titanate phosphates and pyrophosphates, enhances the ballistic properties.

The organo-titanate and organo-zirconate may be incorporated into the propellant composition by admixing prior to casting or molding. Improvement in the dispersibility of the inorganic particles in the resinous matrix is evidenced by reduced binder modulus, giving a finished product with better bonding of the oxidizer particles to the resin, increased tensile strength and elongation. The thus formed propellants have a reduced burn rate exponent, enhanced low pressure combustion stability, and reduced low pressure extinguishment levels.

DETAILED DESCRIPTION OF THE INVENTION

Figure 1:
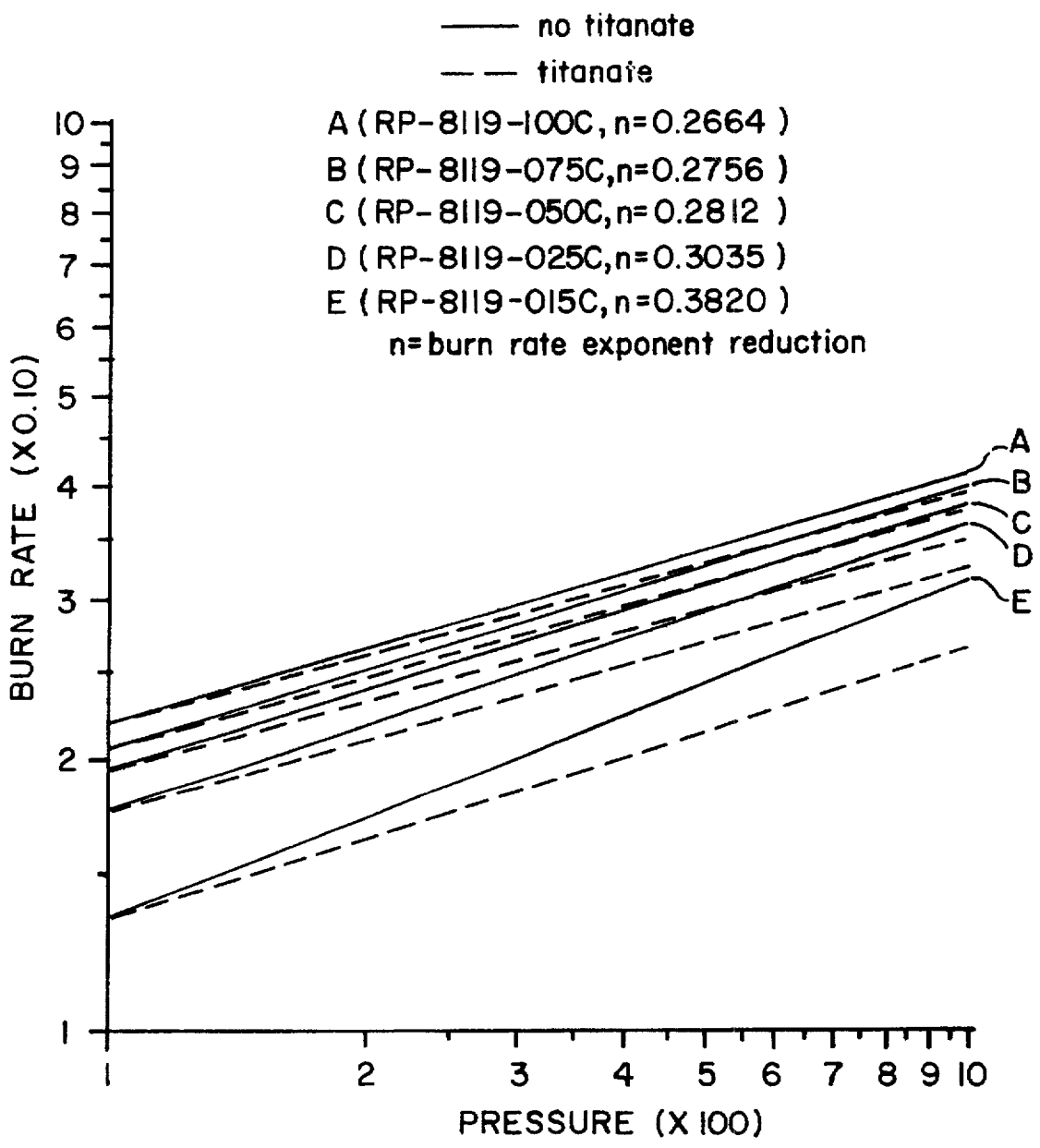
FIG. 1 is a graph of burning rate vs. pressure, showing burning rate exponent reduction of titanate modified propellants compared to propellants without titanates.

Solid propellants are conventionally composed of finely divided inorganic oxidizer material, organic resin which may serve as both a fuel and a binder, additional powdered metals which provide additional combustible material, and minor amounts of other additives such as plasticizers, antioxidants, wetting agents, curatives, metal oxides, and reinforcing agents.

Generally speaking, oxidizers are powdered and vary in size broadly from 1 to 300 microns average particle size, preferably in the range of from 20 to 200 microns. These materials form the major portion of the total composition, generally ranging from 65 to 95% of the total mixture. The fuel binder is usually present in minor proportions of the total composition, generally ranging from 5 to 35% by weight. Generally speaking, it is advantageous to reduce the amount of binder material which is present, since such material adds weight to the total charge and its gas generation per unit weight is less than that provided by powdered metal fuels. The foregoing compositional factors are conventional to the art and described in detail in U.S. Pat. No. 3,050,423.

Certain of the organo-titanates useful in the instant invention have been described in the prior art. These include particularly organo-titanate phosphates and pyrophosphates. These compounds may be represented by the formulas:

I $(R^1—O)_x\ Ti[OP(O)(OR^2)(OR^3)]_y$

II $(R^1—O)_x\ Ti[OP(OH)OP(O)(OR^2)(OR^3)]_y$

III $(R^1—O)_m\ Ti$ 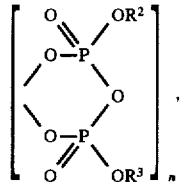

wherein $R^1$ is a monovalent alkyl, alkenyl, alkynyl or aralkyl group having from 1 to 30 carbon atoms or a substituted derivative thereof; $R^2$ and $R^3$ are independently selected from hydrogen, alkyl, alkenyl, aryl, aralkyl or alkaryl groups having from 1 to 30 carbon atoms or substituted derivatives thereof, x and y being integers from 1 to 3, the total of x and y being equal to 4, and m=2 when n=1, and m=0 when n=2. Preferably, $R^1$ is an alkyl group containing from 1 to 6 carbon atoms and $R^2$ and $R^3$ are independently selected from alkyl groups having up to 12 carbon atoms or an aryl or alkaryl group having from 6 to 24 carbon atoms.

U.S. Pat. No. 4,122,062 describes the organo-titanate phosphates and pyrophosphates of formulas I and II generally. As will be shown from the data set forth hereinafter, such materials are particularly useful in the instant invention. Generally from 0.1 to 2.0 parts of the titanate are added, based on the total composition, preferably from 0.2 to 1.0. For ammonium perchlorate and aluminum powder, the most preferred is the addition of 0.3 to 0.4 wt. %.

Although titanium IV, [(2-propenolato-1)methyl, n-propanolato methyl] butanolato-1, tris(dioctyl)phosphato and titanium IV, [(2-propenolato-1)methyl, n-propanolato methyl] butanolato-1, tris(dioctyl)pyrophosphato are the best for increasing the efficiency of metal fuel combustion by preventing the agglomeration of molten metal particles inside the combustion chamber, titanium IV, 2-propanolato, tris(dioctyl)phosphato-0 is the top choice for overall effect on metal combustion, reduction of burn rate exponent, bonding agent effects, and the ability to function as a wetting agent and viscosity depressant.

In the sample propellant formulations tested, the addition of titanates provided positive rheological benefits. Pseudoplastic and especially thixotropic flow behavior was reduced in all cases, bringing about the desired Newtonian behavior. In all cases of titanate addition, the CSVC (critical solids volume content) increased by at least 150%, thus allowing higher solids loading at equal casting viscosity. The practical effect of higher solids loading, aside from processing considerations, is the increase in specific impulse and propellant density. Tables 1 and 2 present data indicating the positive effects of titanate addition to solid propellants from the standpoint of rheology.

While it is preferred to admix the organo-titanates along with the other components of the composition, the instant invention can also be practiced by first treating the solid inorganic particles. The incorporation of the organo-titanates into the composition may be done with conventional processing equipment.

Many medium-shear mixers are suitable for the production of solid propellants. Among the more common types are the sigma blade, bear claw double arm, tangential double arm, vertical two blade planetary, and ribbon blender type. The most common type of mixer is the sigma blade.

Generally, the mixers are of the vacuum hood type with a heating/cooling jacket on the mixing bowl. In most HTPB formulations it is not necessary to heat the propellant to reduce mix viscosity, but the PBAA, PBAN, and CTPB types all require heat. Some propellants, due to shear or cure induced exotherm, must be cooled during the mixing process.

Care must be taken to ensure that the mixer bowl is free of "dead spots". This condition can lead to poor wet out of propellant ingredients, and in some cases dewetting. Poor wetting may result in a fire or explosion. This is especially true in high energy HMX/RDX PEG-NG propellants. Very high shear rates should not be used.

Current propellant binder systems include, but are not limited to, polybutadiene acrylic acid (PBAA), polybutadiene acrylic acid acrylonitrile (PBAN), carboxyl terminated polybutadiene (CTPB), hydroxyl terminated polybutadiene (HTPB), polysulfides, polyether urethanes, polyester urethanes, unsaturated polyesters and acrylics, epoxies, and nonreactive binders such as polyvinyl chloride (PVC), and nitrocellulose (NC) plastisols.

In all cases, the polymeric compound "binds" all propellant ingredients to form an aggregate or composite of sufficient strength to withstand the thermal and mechanical loads of motor operation and vehicle flight.

The titanates may be used to advantage in most propellant binders. Positive effects are observed in the carboxyl terminated butadienes with a total absence of the cure rate problems associated with HTPB binders.

Where polyurethane systems are employed, it is useful to prepare a two-part system consisting of a premix part which contains the majority of the ingredients and a curative part which is composed primarily of the curative. Such techniques will be readily understood by those skilled in the art.

Other elastomers which may be used as the binder are hydroxy terminated butadiene prepolymers such as R45HT made by Arco Chemical Co. and having a functionality of about 2.7. These are described in U.S. Pat. No. 3,932,240.

The particular organo-titanate selected is dependent to a large degree on the physical size of the solid propellant particle being prepared. For example, while the pyrophosphates are found to be outstandingly effective in reducing the burn rate exponent, in urethane systems they suffer the disadvantage of decreasing the cure rate of the catalyst. The organo-phosphates, on the other hand, have substantially no effect on the cure rate.

The catalytic effect that the titanates have on the NCO/OH cure reaction of the propellant binder system can be controlled, when titanates are used as bonding agents, by treating the aluminum or ammonium perchlorate with a solvent solution of the titanate and drying the treated particles. This procedure requires only enough titanate to produce a monolayer on the surface of the solid particles. Since the monolayer is tightly bound to the solid particles, and no excess titanate is present, very little effect on cure rate of the propellant is observed. Less effective, but still a useful approach, is that of blending the titanate and the isocyanate prior to their addition to the rubber portion of the propellant binder.

It has also been discovered that the titanate should be preblended with an ester such as isodecyl pelargonate and the mixture allowed to remain at room temperature for 24 hours to permit transesterification.

Pot life control can be enhanced by the addition of minor amounts of glycols such as 2,4-pentanediol to the curative part just prior to admixture with the premix part of the system.

In summary, titanates provide the ability to increase the solids loading of many propellant formulations, thereby increasing the specific impulse and, in most cases, with an increase in density. The practical advantage is more power in less space. From a mechanical standpoint, greater operational loads can be tolerated, permitting a reduction in weight and size of mechanical components. The increased ability to bond to case liners and other batches of propellant permits more reliable dual-grain designs. All of these factors give the solid rocket motor designer more freedom of choice.

In order to define more clearly the instant invention, attention is directed towards the following examples:

EXAMPLE 1

A premix part is formed by first admixing an ester plasticizer with the titanate and allowing the mixture to stand for 24 hours. Thereafter, a hydroxy-terminated butadiene, aluminum powder (3 microns), carbon black, catacene, and ammonium perchlorate are added with mixing. A curative part is formed by admixing dimer acid diisocyanate with 2,4-pentanedione. The amount of the ingredients is selected so as to form a composition having the following formulation:

TABLE A

| | |
|---|---|
| Ammonium Perchlorate - 200 microns | 55.97 |
| Ammonium Perchlorate - 500 microns | 23.98 |
| Aluminum - 3 microns | 1.25 |
| Carbon Black | .05 |
| Catacene | .15–1.00 on Total |
| Hydroxy-terminated Butadiene (R45-HT) | 12.17 |
| Isodecyl Pelargonate | 3.75 |
| Dimer Acid Diisocyanate | 2.83 |
| (excluding Catacene) | 100.00 |

In the foregoing formulations, the following titanates were added at a level of 0.3% based on weight of the total formulations:

| Code | Titanium Coupling Agent |
|---|---|
| A | Titanium IV, 2-propanolato, tris(dioctyl)phosphato-0 |
| B | Titanium IV, 2-propanolato, tris(dioctyl)pyrophosphato-0 |
| C | Titanium IV, bis(dioctyl)phosphato-0, ethylenediolato |
| D | Titanium IV, [(2-propenolato-1)methyl, n-propanolato methyl]butanolato-1, tris(dioctyl)phosphato |
| E | Titanium IV, [(2-propenolato-1)methyl, n-propanolato methyl]butanolato-1, tris(dioctyl)pyrophosphato |

-continued

| Code | Titanium Coupling Agent |
|---|---|
| F | Titanium IV bis octanolato, cyclo(dioctyl)-pyrophosphato-0,0' |
| G | Titanium IV bis cyclo(dioctyl)pyrophosphato-0,0' |

The data shown in FIG. 1 clearly establish that the titanates of the invention reduce the burn rate exponent of the propellant formulation. While the mechanism for this advantageous result is not fully understood, it may be postulated that the organic titanate bonds to the surfaces of the fuel and forms a non-combustible coating. Additional experiments have shown that the addition of greater amounts of the organo-titanates actually can serve to depress the overall burn rate to the point of extinguishment. For example, 2% of the pyrophosphate titanates extinguish the propellant at pressures below 100 psia, while suppression is realized at 0.6 wt. % levels.

EXAMPLE 2

A propellant formulation of 15% binder, 19% aluminum, with the balance being ammonium perchlorate, was formulated. Small rocket motors were fabricated (1.5 in.×12 in.), which are known to have very short residence times in the combustion chamber. Due to the very short combustion time available, the propellant produced a specific impulse of only 215 pound seconds.

Following are the results for select titanates:

TABLE 1

| Titanate | Specific Impulse, lbs. sec. |
|---|---|
| None | 215 |
| A | 228 |
| B | 234 |
| E | 233 |
| G | 215 |

As can be seen, the pyrophosphate and phosphate materials are much more effective than the heterocyclic types. In certain instances the specific impulse increased by more than 15 lbs. sec. Since residence times remained constant throughout the tests, it is assumed that the titanates prevented the agglomeration of the molten aluminum particles into larger ones that would result in the lower combustion efficiency of the unmodified propellant.

EXAMPLE 3

The effect of titanates on propellant mix viscosity is shown in Tables 2 and 3 below. In each instance, the titanate level was 0.30% of total formulation weight.

TABLE 2

| Titanate | Viscosity (kps) |
|---|---|
| None | 13.2 |
| A | 10.2 |
| B | 11.1 |
| E | 11.6 |
| G | 12.3 |

TABLE 3

| Spindle Speed* | Control | A | B | E | G |
|---|---|---|---|---|---|
| .3 | 13.2 | 10.2 | 11.1 | 11.6 | 12.3 |
| 1.5 | 13.7 | 10.3 | 11.1 | 11.8 | 12.9 |
| 3.0 | 14.0 | 10.5 | 11.6 | 11.7 | 12.9 |

*Brookfield LV viscometer with Helipath stand. Viscosity in kps.

The above tables clearly show that the addition of the titanates in each instance lowers the viscosity of the formulation. The pyrophosphates and the phosphates are the most effective.

EXAMPLE 4

This example shows the effect of titanates as bonding agents on propellant mechanical properties. As in the previous example, 0.3 wt. % of the titanate was used.

TABLE 4

| Temp., °F. | Bonding Agent | Stress[1], PSIG | Strain[2], % | Young's Modulus PSIG |
|---|---|---|---|---|
| 180 | None | 62 | 17 | 455 |
| | A | 84 | 23 | 435 |
| | B | 88 | 27 | 450 |
| | E | 90 | 29 | 458 |
| | G | 63 | 17 | 450 |
| 77 | None | 76 | 18 | 520 |
| | A | 187 | 77 | 512 |
| | B | 191 | 83 | 520 |
| | E | 196 | 85 | 528 |
| | G | 76 | 20 | 520 |
| −45 | None | 278 | 20 | 1940 |
| | A | 423 | 73 | 2533 |
| | B | 428 | 75 | 2530 |
| | E | 436 | 81 | 2590 |
| | G | 270 | 22 | 1910 |

[1]At nominal maximum
[2]Nominal maximum stress

The above data show the improvement of the organo-titanate phosphates and pyrophosphates on the physical properties of the propellants. At −45° F., maximum stress and strain as well as Young's Modulus were improved. At 180° F. and 77° F., the maximum stress and maximum strain were markedly increased.

We claim:

1. A composition of matter comprising: a dispersion of a solid oxidizer within and bonded by a fuel matrix containing from about 0.01 to 5 wt. % of a coupling agent having one of the formulas:

I $(R^1—O)_x Ti[OP(O)(OR^2)(OR^3)]_y$

II $(R^1—O)_x Ti[OP(OH)OP(O)(OR^2)(OR^3)]y$

III $(R^1—O)_m Ti$ 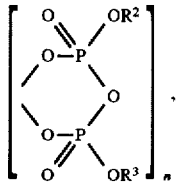

wherein $R^1$ is a monovalent alkyl, alkenyl, alkynyl or aralkyl group having from 1 to 30 carbon atoms or a substituted derivative thereof; $R^2$ and $R^3$ are independently selected from hydrogen, alkyl, alkenyl, aryl, aralkyl or alkaryl groups having from 1 to 30 carbon atoms or substituted derivatives thereof; x and y being integers from 1 to 3, the total of x and y being equal to 4, and m=2 when n=1, and m=0 when n=2.

2. The composition of matter of claim 1 wherein $R^1$ is an alkyl group containing from 1 to 6 carbon atoms and $R^2$ and $R^3$ are independently selected from alkyl groups having up to 12 carbon atoms or an aryl or alkaryl group having from 6 to 24 carbon atoms.

3. The composition of matter of claim 1 wherein the dispersion contains from about 0.1 to 2 wt. % of the coupling agent.

4. The composition of matter of claims 1, 2, or 3 wherein the dispersion contains one or more of the components selected from powdered metals, plasticizers, antioxidants, wetting agents, curatives, burn modifiers, reinforcing agents, bonding agents, and inert fillers.

5. The composition of matter of claim 1 wherein the fuel matrix is polybutadiene acrylic acid, polybutadiene acrylic acid acrylonitrile, carboxyl terminated polybutadiene, hydroxyl terminated polybutadiene, polysulfide, polyether urethane, polyester urethane, unsaturated polyester, acrylic, epoxy, polyvinyl chloride or nitrocellulose plastisol.

6. The composition of matter of claim 1 wherein the solid oxidizer is ammonium perchlorate.

7. The composition of matter of claim 1 wherein the coupling agent is titanium IV, [(2-propenolato-1)methyl, n-propanolato methyl] butanolato-1, tris(dioctyl) phosphate.

8. The composition of matter of claim 1 wherein the coupling agent is titanium IV, [(2-propenolato-1)methyl, n-propanolato methyl] butanolato-1, tris(dioctyl) pyrophosphato.

9. The composition of matter of claim 1 wherein the coupling agent is titanium IV, 2-propanolato, tris(dioctyl) phosphato-0.

10. The composition of matter of claim 1 wherein from 65 to 95 wt. % of the oxidizer and from 5 to 35 wt. % of the fuel matrix are present.

11. The composition of matter of claim 1 wherein aluminum powder is present.

12. A composition of matter comprising a dispersion of an ammonium perchlorate solid oxidizing agent within and bounded by a hydroxy-terminated butadiene fuel matrix containing from about 0.1 to 5 wt. % of a coupling agent selected from the group consisting of titanium IV, [(2-propenolato-1)methyl, n-propanolato methyl] butanolato-1, tris(dioctyl) phosphato; titanium IV, [(2-propenolato-1) methyl, n-propanolato methyl] butanolato-1, tris(dioctyl) pyrophosphato; and titanium IV, 2-propanolato, tris( dioctyl) phosphato-0.

* * * * *